United States Patent [19]

Halewijn et al.

[11] 4,331,274

[45] May 25, 1982

[54] TRACKING SYSTEM

[75] Inventors: Harry J. Halewijn, Manchester; Arnold H. Cohen, Andover, both of Mass.

[73] Assignee: Itek Corporation, Lexington, Mass.

[21] Appl. No.: 195,894

[22] Filed: Oct. 14, 1980

[51] Int. Cl.[3] ..... B65H 25/26

[52] U.S. Cl. ..... 226/15; 242/57.1

[58] Field of Search ..... 226/3, 15, 16, 17, 21, 226/18; 242/57.1; 26/51.4, 51.5; 271/227, 250, 252, 258, 261

[56] References Cited

U.S. PATENT DOCUMENTS

| | | | |
|---|---|---|---|
| 1,596,954 | 8/1926 | Tuttle | 226/17 |
| 3,323,699 | 6/1967 | Bricker | 226/16 |
| 3,323,740 | 6/1967 | Blessing | 226/15 X |
| 3,971,496 | 7/1976 | Karsh | 226/15 |
| 4,007,865 | 2/1977 | Crandall | 226/17 |
| 4,054,251 | 10/1977 | Henderson | 226/15 |

*Primary Examiner*—Edward J. McCarthy
*Attorney, Agent, or Firm*—Homer O. Blair; Robert L. Nathans; Gerald H. Glanzman

[57] ABSTRACT

An elongated sheet transport and guidance system including a drive roller mounted for rotation on a frame and adapted to engage and frictionally drive the sheet along its longitudinal axis and a pinch roller engaging the drive roller and mounted for rotation on an axis parallel thereto, the pinch and drive rollers being arranged to straddle and exert a pressure on that portion of the sheet passing therebetween. Also included in the system is a first means for inducing a first pressure level between the pinch and drive rollers in a region adjacent one longitudinal edge of the traveling sheet and a second means for inducing a second pressure level between the pinch and drive rollers in a region adjacent the opposite longitudinal edge of the sheet. In response to the output of a sensing means that senses lateral displacement of the traveling sheet, a control mechanism varies the difference between the first and second pressure levels. The control mechanism causes the first pressure level to increase relative to the second pressure level in response to lateral displacement of the sheet in one sense and causes the second pressure level to increase relative to the first pressure level in response to lateral displacement of the sheet in the opposite sense.

17 Claims, 6 Drawing Figures

TRACKING SYSTEM

BACKGROUND OF THE INVENTION

This invention relates generally to a transport system for elongated sheet material and, more particularly, to such a system for feeding such material along a fixed longitudinal axis.

There exist many types of sheet material feed apparatus that include regulation systems for maintaining the traveling sheet material on a fixed longitudinal axis. Typically, the regulation systems comprise one or more sensing devices that determine dynamically the lateral position of at least one longitudinal edge of the traveling sheet. The sensing device determines whether the observed position of the longitudinal edge complies with the longitudinal alignment requirements for the traveling sheet material. Depending upon the particular sheet material being handled and other operating conditions, the sensors can include photosensitive detectors, pressure change detectors, mechanical feelers, etc. In response to an output from the sensing device indicating an unacceptable lateral displacement, a positioning mechanism is actuated to realign the traveling sheet. Prior positioning devices have includes, for example, servo mechanisms for axially shifting a supply roller from which the sheet is being drawn, mechanisms for controlling the tilt of transport drive rollers, and mechanisms for producing axial translation of drive rollers. All such prior positioning devices suffer collectively or individually from a number of deficiencies such as being complicated, expensive, unreliable, etc. Also known are positioning devices that maintain desired alignment by spreading or stretching a sheet material. These latter systems obviously are unsuitable for use with non-stretchable sheet material such as paper and metal.

The object of this invention, therefore, is to provide an elongated sheet transport and guidance system that combines the features of simplicity, inexpensiveness and reliability.

SUMMARY OF THE INVENTION

The invention is an elongated sheet transport and guidance system including a drive roller mounted for rotation on a frame and adapted to engage and frictionally drive the sheet along its longitudinal axis and a pinch roller engaging the drive roller and mounted for rotation on an axis parallel thereto, the pinch and drive rollers being arranged to straddle and exert a pressure on that portion of the sheet passing therebetween. Also includes in the system is a first means for inducing a first pressure level between the pinch and drive rollers in a region adjacent one longitudinal edge of the traveling sheet and a second means for inducing a second pressure level between the pinch and drive rollers in a region adjacent the opposite longitudinal edge of the sheet. In response to the output of a sensing means that senses lateral displacement of the traveling sheet, a control mechanism varies the difference between the first and second pressure levels. The control mechanism causes the first pressure level to increase relative to the second pressure level in response to lateral displacement of the sheet in one sense and causes the second pressure level to increase relative to the first pressure level in response to lateral displacement of the sheet in the opposite sense. By selectively varying the relative pressures applied at opposite ends of the drive and pinch rollers, the system corrects lateral displacements of the traveling sheet detected by the sensing device.

In a preferred embodiment of the invention, the sensing mechanism comprises a photodetector responsive to radiant energy from a predetermined zone and having a variable output signal dependent upon the lateral position in that zone of a longitudinal edge of the traveling sheet, and the control mechanism comprises a control circuit that produces a first control signal to relatively increase the first pressure level in response to a detector output signal value below a predetermined minimum and produces a second control signal to relatively increase the second pressure level in response to a detector output signal value above a predetermined maximum. Detector outputs in the range between the maximum and minimum levels represent lateral sheet displacements within an acceptable range and result in no corrective action by the control system. This arrangement prevents the occurrence of continuous corrective action that would cause the traveling sheet to oscillate in an under damped mode until instability eventually produced jamming or tearing.

According to another feature of the invention, the drive roller is provided with a bi-directional driving mechanism so as to alternately move the sheet in either a forward or reverse direction and an inhibit means is provided for deactivating the control system during movement in the reverse direction. This feature is useful in certain systems in which feed instability is created during periods that a sheet is being pushed in a reverse direction rather than being pulled in a forward direction.

DESCRIPTION OF THE DRAWINGS

These and other objects and features of the present invention will become more apparent upon a perusal of the following description taken in conjunction with the accompanying drawings wherein.

DESCRIPTION OF THE PREFERRED EMBODIMENT

Figure 1:
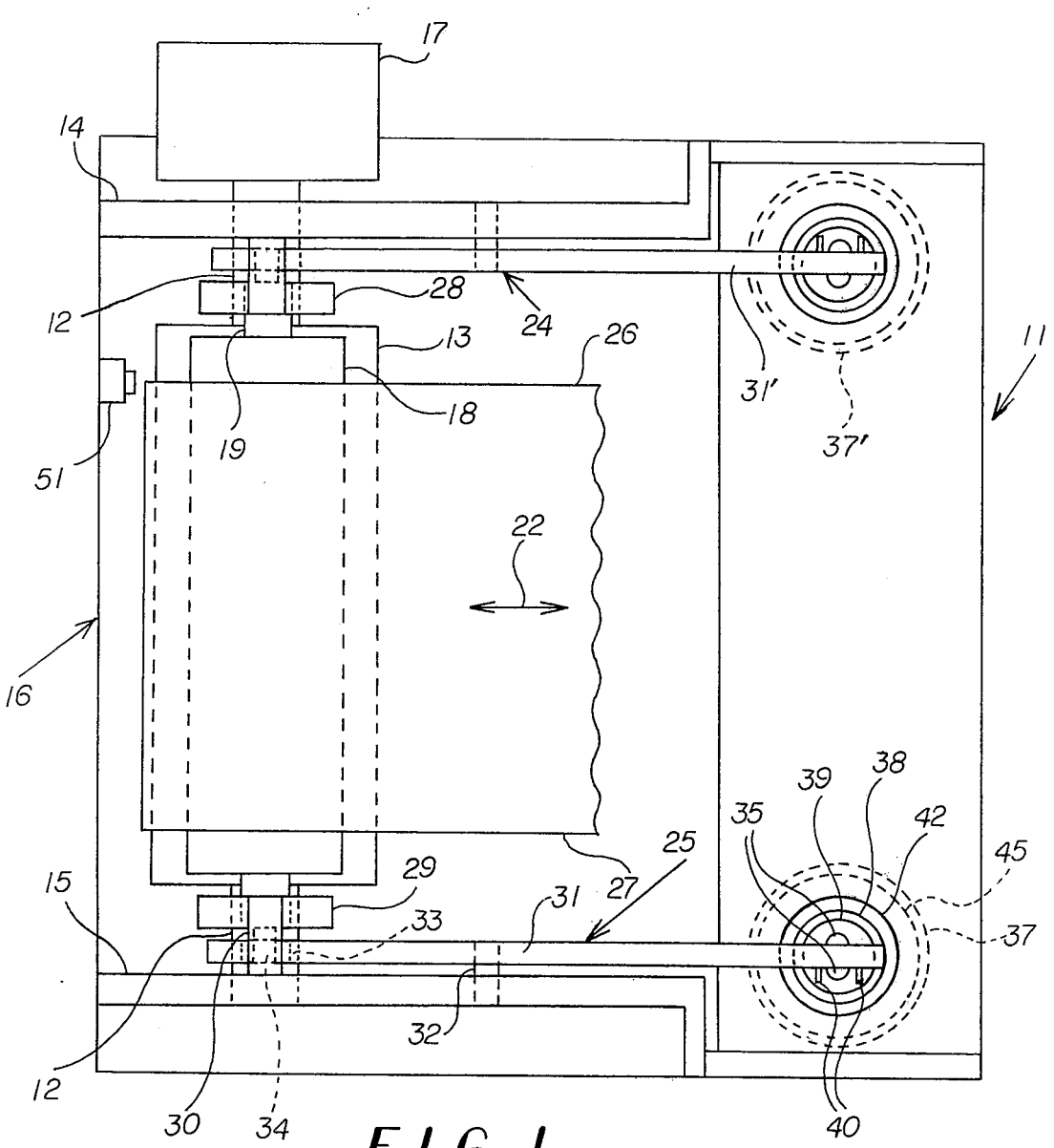
FIG. 1 is a schematic top view of an elongated sheet transport and guidance system according to the invention.
Figure 2:
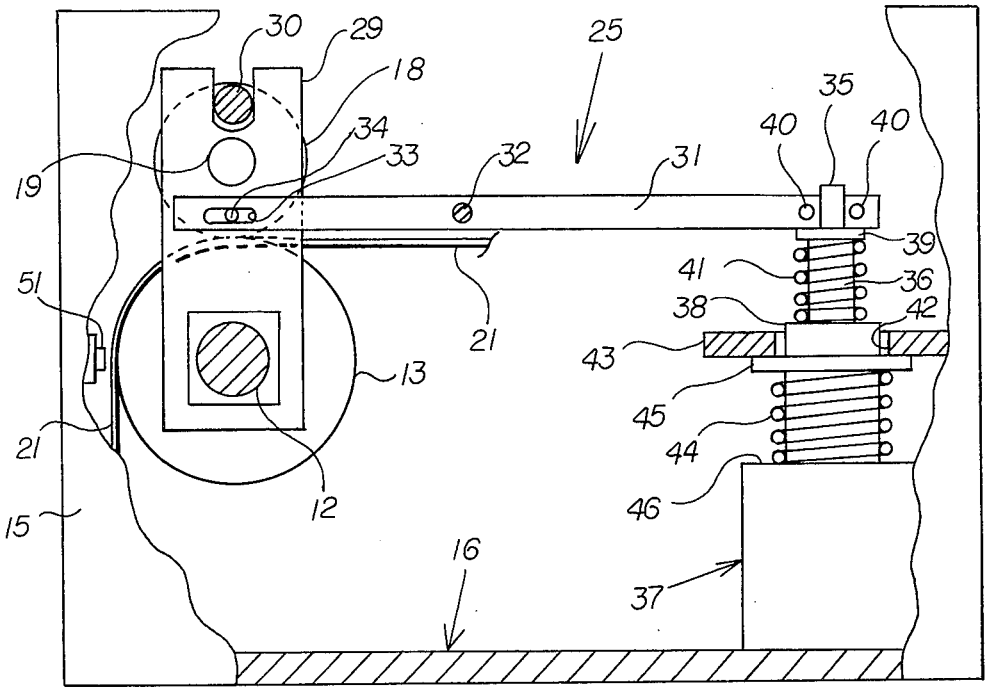
FIG. 2 is a schematic, partially cutaway sectional side view of the system shown in FIG. 1.

Illustrated in FIGS. 1 and 2 is a transport and guidance system 11 which will be specifically described for use as a paper feed apparatus for a phototypesetting machine. A shaft 12 of a drive roller 13 is rotatably mounted between spaced apart walls 14, 15 of a frame 16. The drive roller 13 is made of a suitable resilient material such as rubber and the shaft 12 is coupled to a bi-directional drive assembly 17. Engaging the drive roller 13 and extending parallel thereto is a pinch roller 18 mounted on a shaft 19. The drive roller 13 and the pinch roller 18 straddle and frictionally engage an elongated paper sheet 21 that is fed from a supply roll (not shown) to a location (not shown) in which phototypesetting operations occur. In response to selective energization of the drive mechanism 17 the paper sheet 21 is alternately driven in either a forward or a reverse direction as indicated by the arrow 22.

Disposed at opposite ends of the pinch roller 18 are, respectively, a first pressure applicator 24 and a second pressure applicator 25. The first pressure applicator 24 induces a first pressure level between the rollers 13 and 18 adjacent one longitudinal edge 26 of the sheet 21 while the second pressure applicator 25 induces a second pressure level between the rollers 13 and 18 adjacent an opposite longitudinal edge 27 of the sheet 21. Included in the first and second pressure applicators 24 and 25, respectively, are spaced apart brackets 28 and 29 that retain the pinch roller shaft 19. Horizontal containment of the bracket 29 and accordingly of the pinch roller 18 is provided by a pin 30 that extends from the side wall 15 of the frame 16 and is received by a vertically elongated slot in the top surface of the bracket 29. As shown most clearly in FIG. 2, the second pressure applicator 25 further includes a lever arm 31 that is pivotally mounted on the side wall 15 by a pivot pin 32. Extending through an oblong opening 33 at one end of the lever arm 31 is a pin 34 that is fixed to the support bracket 29. The opposite end of the lever arm 31 is received by the bifurcated terminal portion 35 of a plunger 36 associated with a solenoid 37. Retaining one leg of the bifurcated plunger portion 34 are pins 40 that extend from the lever arm 31. A bias spring member 41 is retained between a shoulder portion 38 of the plunger 36 and a slidable collar 39 thereon. Another spring member 44 is retained between an annular extension 45 on the plunger 36 and an upper housing portion 46 of the solenoid 37. As shown in FIG. 2, the spring member 44 normally biases the plunger 36 in an upward position wherein the shoulder portion 38 extends through an opening 42 in a horizontal wall portion 43 of the frame 16. It will be understood that the first pressure applicator 24 is identical to the second pressure applicator 25 shown in FIG. 2 and will therefore not be described in detail.

Figure 3:
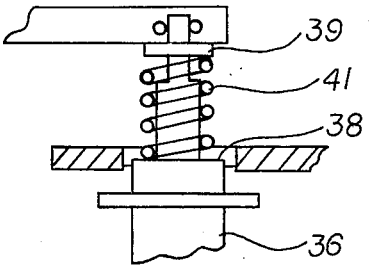
FIG. 3 is a schematic detailed view of a solenoid assembly illustrated in FIG. 2 but shown in a different operating position.

As shown in FIG. 2, the spring member 44 normally biases the plunger 36 in an upward position wherein the annular extension 45 engages the underside of the horizontal wall portion 43. The spring member 41 exerts via the collar 39 a force on the lever arm 31. That force is transmitted by the pin 32 to the bracket 29 and results in the application of pressure between the drive roller 13 and the pinch roller 18. Thus, the second pressure applicator 25 produces between the drive roller 13 and the pinch roller 18 in a region adjacent to the longitudinal edge 27 of the sheet 21 a given pressure level determined by the spring member 41. Energization of the solenoid 37, however, draws the plunger 36 downwardly to expand the spring member 41 as shown in FIG. 3. This reduces the force applied by the spring member 41 to the lever arm 31 and results in a reduction in the pressure applied between the drive roller 13 and the pinch roller 18 in the region adjacent to the longitudinal edge 27 of the sheet 21. It will be appreciated that the first pressure applicator 24 will function in the same manner to vary the pressure level that is applied between the drive roller 13 and the pinch roller 18 in the region adjacent to the opposite longitudinal edge 26 of the sheet 21.

Figure 4:
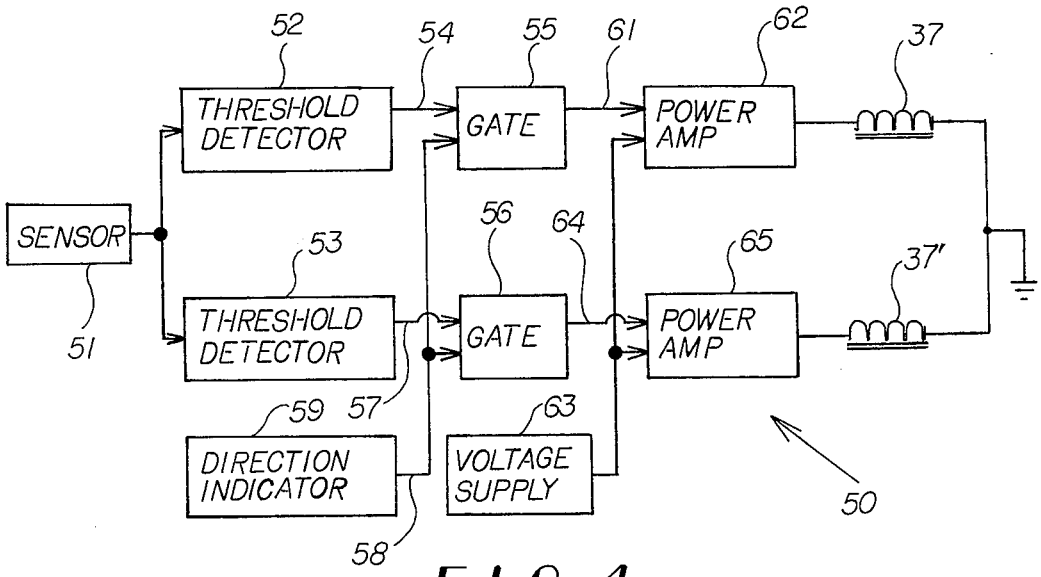
FIG. 4 is a schematic block diagram of an electrical control circuit for the system shown in FIG. 1.

Referring now to FIG. 4, there is shown in schematic block diagram form a control circuit 50 for controlling the operation of the first and second pressure applicators 24 and 25. Providing an input for the control circuit 50 is a sensor 51 that detects lateral displacement of the traveling paper sheet 21. Preferably, the sensor 51 comprises a reflective type photodetector mounted on the frame 16 adjacent to the longitudinal edge 26 of the sheet 21 as shown in FIGS. 1 and 2. The detector 51 produces an output signal that is applied to a pair of threshold detectors 52 and 53. Receiving the output of the threshold detector 52 on a line 54 is a gate 55 while a gate 56 receives on a line 57 the output of the threshold detector 53. Also received by each of the gates 55 and 56 on a line 58 is a signal from a direction indicator 59 only during periods of which the sheet 21 is traveling in a reverse direction. The gate 55 produces on a line 61 a first control signal that controls a power amplifier 62 connected between a voltage supply 63 and the first solenoid 37' of the first pressure applicator 24. Similarly, the gate 56 produces on a line 64 a second control signal that controls a power amplifier 65 connected between the voltage supply 63 and the second solenoid 37 of the second pressure applicator 25. In response to a signal output on either of the lines 54 or 58, a control output of the gate 55 deactivates the power amplifier 62 and deenergizes the solenoid 37. Conversely, the gate 56 produces a control output that activates the power amplifier 65 to energize the solenoid 37' only in response to the presence of a signal on the line 57 and the absence of a signal on the line 58.

Figure 5:
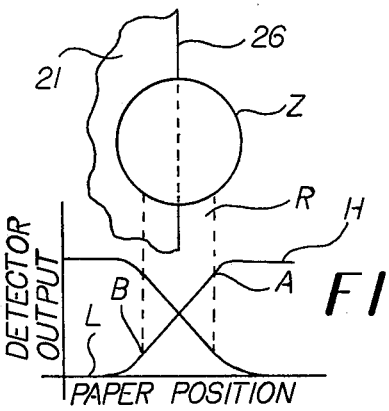
FIG. 5 is a schematic diagram illustrating the signal output of a sheet position sensor used in the system of FIGS. 1 and 2.

The operation of the control circuit 50 will be described in conjunction with FIG. 5 in which the circle Z represents a zone encompassing the field of view of the photodetector 51 and through which passes the longitudinal edges 26 of the sheet 21. The sheet 21 is shown with the longitudinal edge 26 in the desired alignment extending through the center of the zone Z. Diagrammed in FIG. 5 is the signal output of the detector 51 versus the lateral position of the longitudinal edge 26 in the zone Z. As indicated, the detector 51 which is responsive to radiant energy reflected from the sheet 21 produces an output that varies between a high value H and a low value L. The highest level H is produced by a rightward displacement of the edge 26 that results in total occupation of the zone Z by the sheet 21. Conversely, the lowest output level L is produced by a leftward displacement of the edge 26 resulting in a complete withdrawal of the sheet 21 from the zone Z. The present invention establishes a certain acceptable range of lateral sheet displacements on either side of the desired edge position through the center of the zone Z. This acceptable lateral displacement is represented by the region R bounded by dotted lines in FIG. 5. As indicated, the extremities of the acceptable displacement region R are represented by a maximum detector output A and a minimum detector output B. The maximum and minimum acceptable detector output levels A and B, respectively, are the response levels required for the activation of the threshold detectors 53 and 52, respective.

Referring again to FIG. 4, the circuit operation of the control circuit 50 will be described. During periods in which the longitudinal edge 26 of the sheet 21 is moving within the acceptable displacement region R, the output of the detector 51 is between the maximum level A and the minimum level B. Therefore, the response level of the threshold detector 52 is exceeded providing an output on the line 54. The gate 55 responds to that signal by producing a control signal on the line 61 that deactivates the power amplifier 62 and maintains the solenoid 37' deenergized. Conversely, the response of the threshold detector 53 is not exceeded and no output signal appears on the line 57. Consequently, the gate 56 produces no control signal on the line 64 to activate the power amplifier 65 and the solenoid 37 also remains deenergized. Thus, during movement of the sheet 21 within the predetermined acceptable displacement limits, both solenoids 37' and 37 remain deenergized and equal pressures are applied at opposite ends of the pinch roller 18 by the spring members 41.

Assume next the occurrence of a rightward displacement of the longitudinal edge 26 beyond the acceptable region as viewed in FIG. 5. This results in a detector output above the maximum level A and causes the threshold detector 53 to produce an output on the line 57. In response to that output, that gate 56 produces a control signal on the line 64 that activates the power amplifier 65 to energize the solenoid 37'. As described above, this in turn causes the first pressure applicator 24 to reduce the pressure level applied between the rolls 13 and 18 adjacent the longitudinal edge 26 and results in a relative increase in the pressure applied adjacent the longitudinal edge 27. The relatively higher pressure applied by rollers 13 and 18 adjacent to the longitudinal edge 27 causes the sheet 21 to move toward the downwardly direction (as viewed in FIG. 1) to correct the detected displacement. This corrected action is discontinued once the edge 26 is returned to the acceptable displacement region R.

Assume next a leftward displacement of the edge 26 beyond the acceptable region R. This produces a decrease in the detector output to below the minimum value B and eliminates a signal output from the threshold detector 52. Consequently, the gate 55 produces a control signal on the line 61 that activates the power amplifier to energize the solenoid 37. As described above, the energization of the solenoid 37 causes the second pressure applicator 25 to reduce the pressure applied between the rollers 13 and 18 adjacent the longitudinal edge 27 resulting in a relative increase in the pressure level applied adjacent the longitudinal edge 26. The traveling sheet 21 responds to this differential in applied pressure by moving upwardly (as viewed in FIG. 1) until the edge 26 again reaches the acceptable displacement region R at which time the solenoid 37 is again deenergized and further corrective action is discontinued.

Figure 6:
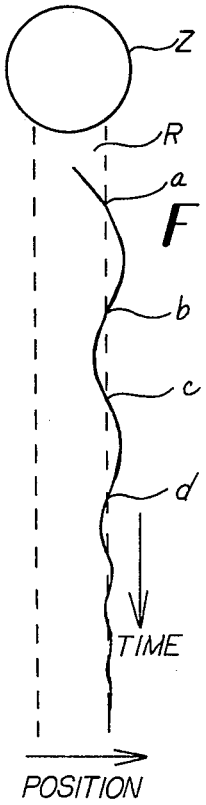
FIG. 6 is a schematic diagram illustrating the manner in which the system of FIGS. 1 and 2 controls lateral positioning of a traveling sheet.

FIG. 6 diagrammatically illustrates corrective action of the system 11 during typical operation. Generally, in any particular setup a sheet will have an inherent tendency toward displacement in one direction. Here it is assumed that the natural tendency is toward rightward displacement as viewed in FIG. 6. Thus, the detected edge moves rightwardly to point a at which time an appropriate solenoid is energized to produce corrective action until time b when such action is discontinued. After a short period of corrective overshoot, the edge again resumes moving rightwardly to point c at which corrective action is again introduced producing a more rapid return to the acceptable region R and discontinuation of correction at point d. Thereafter, the edge will continue to gently "bounce" off the right boundary of the region R producing intermittent energization of the corrective solenoid. Obviously, a tendency for movement to the left as viewed in FIG. 6 would result in energization of the alternate solenoid in a similar corrective action.

In certain feed installations it is desirable that no corrective action take place during reverse movement of the sheet 21. This feature is provided in the system 11 by the direction indicator 59 shown in FIG. 4. During periods of reverse movement, the direction indicator 59 produces an output signal on the line 58 that is applied to both of the gates 55 and 56. The signal to the gate 55 produces a control signal on line 61 that deactivates the power amplifier 62 and deenergizes the solenoid 37. Similarly, the signal to the gate 56 eliminates a control signal on the line 64 to maintain the power amplifier deactivated and the solenoid 37' deenergized.

Obviously, many modifications and variations of the present invention are possible in light of the above teachings. For example only, the function of the direction indicator 58 can be eliminated in certain applications resulting in position control in both the forward and reverse feed directions; the detector 51 could be used in conjunction with a second detector monitoring the edge 27 of the sheet 21; or one of the solenoids 37, 37' could be eliminated by using springs 41 of unequal force for the first and second pressure applicators 24 and 25. The latter case, however, would entail continuous corrective action that moves the edge 26 of the sheet 21 sequentially between positions aligned with the boundaries of the acceptable region R shown in FIG. 5. It is to be understood, therefore, that the invention can be practiced otherwise than as specifically described.

What is claimed is:

1. An elongated sheet transport and guidance system comprising:

a frame means;

a drive roller mounted for rotation on said frame means and adapted to engage and frictionally drive the sheet along its longitudinal axes;

a drive means operatively coupled to said drive roller;

a pinch roller engaging said drive roller and mounted for rotation on an axis parallel thereto, said pinch and drive rollers arranged to straddle and exert a pressure on that portion of the sheet passing therebetween;

first means for inducing a first pressure level between said pinch and drive rollers in a region adjacent one longitudinal edge of the traveling sheet;

second means for inducing a second pressure level between said pinch and drive rollers in a region adjacent a longitudinal edge of the traveling sheet opposite to said one edge; sensing means for sensing lateral displacement of the traveling sheet;

control means for varying the difference between said first and second pressure levels in response to said sensing means and for causing said first pressure level to increase relative to said second pressure level in response to lateral displacement of the sheet in one sense and for causing said second pressure level to increase relative to said first pressure level in response to lateral displacement of the sheet in a sense opposite to said one sense.

2. A system according to claim 1 wherein said control means comprises limit means for causing said difference between said first and second pressure levels to remain constant in response to lateral displacement of the sheet in a range between a given maximum displacement in said one sense and a given maximum displacement in said opposite sense.

3. A system according to claim 2 wherein said sensing means comprises a detector means for detecting the lateral position of a longitudinal edge of the traveling sheet.

4. A system according to claim 3 wherein said detector comprises a photodetector means responsive to radiant energy from a predetermined zone and having a variable output signal dependent upon the lateral position of said longitudinal edge in said predetermined zone.

5. A system according to claim 4 wherein said control means comprises control circuit means that produces a first control signal that causes said relative increase in said first pressure level in response to a level of said output signal below a minimum output level and produces a second control signal that causes said relative increase in said second pressure level in response to a level of said output signal above a maximum output level.

6. A system according claim 5 wherein said first means comprises a first variable pressure applicator means responsive to said first control signal, and said second means comprises a second variable pressure applicator means responsive to said second control signal.

7. A system according to claim 6 wherein said first pressure applicator comprises a first spring means producing said first pressure level and a first solenoid means coupled thereto and adapted to change the pressure level produced thereby in response to said first control signal, and said second pressure applicator comprises a second spring means producing said second pressure level and a second solenoid means coupled thereto and adapted to change the pressure level produced thereby in response to said second control signal.

8. A system according to claim 1 wherein said sensing means comprises a detector means for detecting the lateral position of a longitudinal edge of the traveling sheet.

9. A system according to claim 8 wherein said detector comprises a photodetector means responsive to radiant energy from a predetermined zone and having a variable output signal dependent upon the lateral position of said longitudinal edge in said predetermined zone.

10. A system according to claim 1 wherein said drive means is adapted to produce bi-directional rotation of said drive roller so as to move the sheet in either a forward or a reverse direction, and including inhibit means for deactivating said control means during said movement in said reverse direction.

11. A system according to claim 10 wherein said control means causes said first pressure level to increase relative to said second pressure level in response to lateral displacement of the sheet in one sense and causes said second pressure level to increase relative to said first pressure level in response to lateral displacement of the sheet in a sense opposite to said one sense.

12. A system according to claim 11 wherein said control means comprises limit means for causing said difference between said first and second pressure levels to remain constant in response to lateral displacement of the sheet in a range between a given maximum displacement in said one sense and a given maximum displacement in said opposite sense.

13. A system according to claim 12 wherein said sensing means comprises a detector means for detecting the lateral position of a longitudinal edge of the traveling sheet.

14. A system according to claim 13 wherein said detector comprises a photodetector means response to radiant energy from a predetermined zone and having a variable output signal dependent upon the lateral position of said longitudinal edge in said predetermined zone.

15. A system according to claim 14 wherein said control means comprises control circuit means that produces a first control signal that causes said relative increase in said first pressure level in response to a level of said output signal below a minimum output level and produces a second control signal that causes said relative increase in said second pressure level in response to a level of said output signal above a minimum output level.

16. A system according to claim 15 wherein said first means comprises a first variable pressure applicator means responsive to said first control signal, and said second means comprises a second variable pressure applicator means responsive to said second control signal.

17. A system according to claim 16 wherein said first pressure applicator comprises a first spring means producing said first pressure level and a first solenoid means coupled thereto and adapted to change the pressure level produced thereby in response to said first control signal, and said second pressure applicator comprises a second spring means producing said second pressure level and a second solenoid means coupled thereto and adapted to change the pressure level produced thereby in response to said second control signal.

* * * * *